United States Patent [19]

Stevens et al.

[11] 4,339,132

[45] Jul. 13, 1982

[54] LACROSSE GOAL

[76] Inventors: Lee D. Stevens, 65 Bishop Dr., Aston, Pa. 19014; Harry C. Grau, 1329 Colton Rd., Gladwyne, Pa. 19035

[21] Appl. No.: 245,384

[22] Filed: Mar. 19, 1981

[51] Int. Cl.[3] ..... A63B 63/02

[52] U.S. Cl. ..... 273/400; 273/127 B

[58] Field of Search ..... 273/398–402, 273/410, 411, 177, 127 R, 127 B

[56] References Cited

U.S. PATENT DOCUMENTS 2,103,428 12/1937 Lutes ..... 273/127 B 4,018,443 4/1977 Bird ..... 273/127 B

OTHER PUBLICATIONS

Lacrosse, Bob Scott ©1976, pp. 19 & 128.

*Primary Examiner*—Paul E. Shapiro

[57] ABSTRACT

A frame for a lacrosse goal is disclosed which comprises two upright frame members, a crossbar frame member joining the upper ends of the upright members defining a plane and enclosing that portion which constitutes a goal mouth, and a base perpendicular thereto, which base is comprised of two leg members, each of which joins one of the uprights at its lower end and interconnects with the other leg member at the rear of the base, in which a first portion of each leg immediately rearward of the goal mouth, forms an obtuse angle with the plane of the goal mouth, and a second portion of each leg, beginning at a point disposed at a distance from the plane of the goal mouth, forms an acute angle with the plane of the goal mouth.

4 Claims, 2 Drawing Figures

LACROSSE GOAL

BACKGROUND OF THE INVENTION

Lacrosse is a game which has been played on the North American Continent for many hundreds of years. In recent years the game has taken on a more formalized structure and has involved league play at the collegiate and amateur level, as well as some professional level play. There are rule-making authorities, such as the United States Intramural Lacrosse Association (USILA) for collegiate and scholastic level play, and a tournament is held to determine a recognized national collegiate champion each year.

The game is scored by attempting to put a ball into the goal of the opposing team. The ball, of a hard, elastomeric composition is carried and tossed or thrown from a stick. Traditionally the stick was composed of a formed hardwood handle with a triangular net of leather, string or gut at one end. More recently a stick with a metal handle and plastic head has become common. Until recently, the goal, which sat on the ground of the playing field, had consisted of a net-covered frame. This frame consisted of two uprights which were joined by a crossbar at their upper ends, and a triangular base composed of two legs, each attached to the lower end of one of the uprights and joined to the other leg. The triangular base extended to the rearward perpendicular to the plane of the goal mouth formed by the uprights and the crossbar. Approval and use of modern materials for the lacrosse stick as described above has led to harder and faster shots on the goal, and this led to problems with the traditional form of the goal. A ball thrown at the goal from the side would occasionally pass through the goal mouth, technically scoring a goal, and bounce directly back out onto the playing field after contact with a portion of the leg immediately rearward to the goal mouth. Because of the speed of the shot, an official might not be able to judge whether the shot crossed the goal mouth and struck the leg, and should thus be ruled a goal, or merely struck an upright, resulting in no goal and the continuation of play.

The number of instances of this type of uncertainty has led at least one rule-making authority to ban the use of this traditional goal. They insisted that league play take place with a goal with no rear leg members, and in which the upright frame members had extensions which continued into the ground. The net, which was traditionally anchored in some fashion to the legs of the goal, was instead to be anchored directly on the ground. While such a goal was able to overcome the problem described above, there were several reaons why it was not generally regarded as suitable. The first problem with the use of such a goal was its permanence. The prior goal had the advantage of its portability, and could be moved from the playing field if the field was to be used for other activities. Anchoring the uprights and the net to the ground precluded this kind of portability and use of the field for any other purpose was thus complicated. Secondly, occasional weather changes causing repeated freezing and thawing caused the uprights to rise out of the ground. This creates a difficulty in keeping the area of the goal mouth of a regulation size.

OBJECTS OF THE PRESENT INVENTION

It is an object of the present invention to provide a frame for a lacrosse goal which will prevent the lacrosse ball from returning onto the playing field after entering the goal mouth.

It is further an object of the present invention to provide a frame for a lacrosse goal which will be easily removable from the playing surface.

The other objects, features and advantages of the present invention are pointed out with particularity in the claims annexed to this specification. Further, they will become more apparent in light of the detailed description of the preferred embodiment thereof and as illustrated in the accompanying drawings.

According to the present invention, there is provided a frame for a lacrosse goal comprising: two upright frame members; a crossbar frame member joining the upper ends of the upright members, said crossbar together with the upright members defining a vertical plane and enclosing that portion thereof which constitutes a goal mouth; a base having two leg members, each leg member having a first end interconnected with the other leg at the rear periphery of the frame and a second end which connects to the lower end of one of the upright members, said base extending rearward in the plane perpendicular to the plane of the goal mouth, thereby defining a goal enclosure; in which a first portion of each said leg immediately rearward of the goal mouth forms an obtuse angle with the plane of the goal mouth, and a second portion of each said leg, beginning at a point disposed at a slight distance from the plane of the goal mouth, forms an acute angle with the plane of the goal mouth.

DETAILED DESCRIPTION OF THE PRESENT INVENTION

Figure 1:
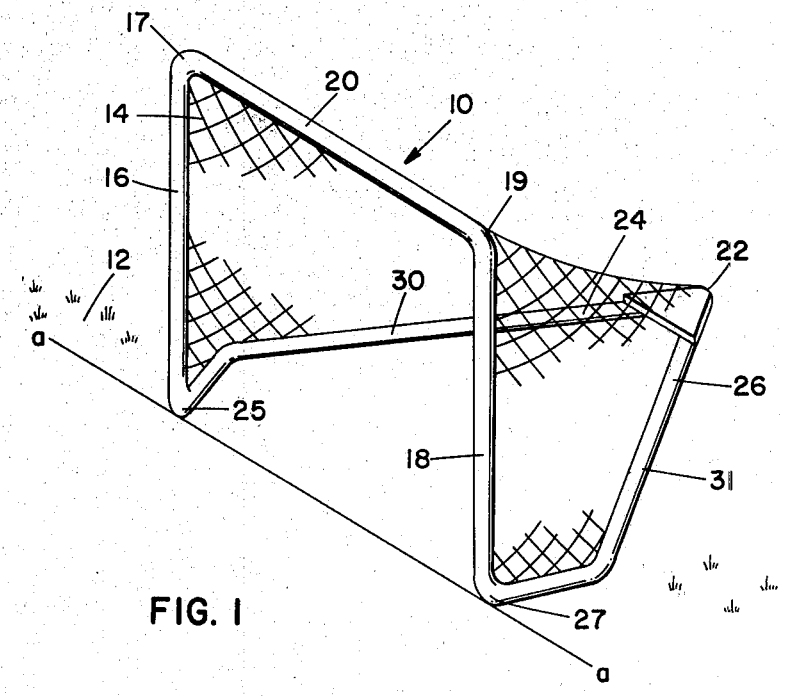
FIG. 1 shows the frame for a lacrosse goal of the present invention, as it would appear in use covered by a standard lacrosse net.

The frame of a lacrosse goal of the present invention is shown as it would appear in use in FIG. 1. The frame (10) is shown sitting on a playing surface (12) as a free standing structural unit. When used in play, the frame (10) would be covered by a net (14).

The frame (10) consists of two upright frame members (16) and (18). These uprights (16) and (18) are joined at their upper ends (17) and (19) by a crossbar frame member (20). The two uprights (16) and (18) and the crossbar (20) lie in the same vertical plane, which is perpendicular to the playing surface (12). Together, the two uprights (16) and (18) and the crossbar (20) define a goal mouth which is closed in on the fourth side by the playing surface (12) along the line shown as (aa) in FIG. 1. A base (22) lies in the plane of the playing surface (12) and extends both perpendicular to and rearward to the plane of the goal mouth. This base is comprised of two leg members (24) and (26) each of which interconnects with the lower end of one of the upright frame members (16) and (18) at (25) and (27) respectively. These legs (24) and (26) interconnect with each other at the rear periphery of the frame (10).

Figure 2:
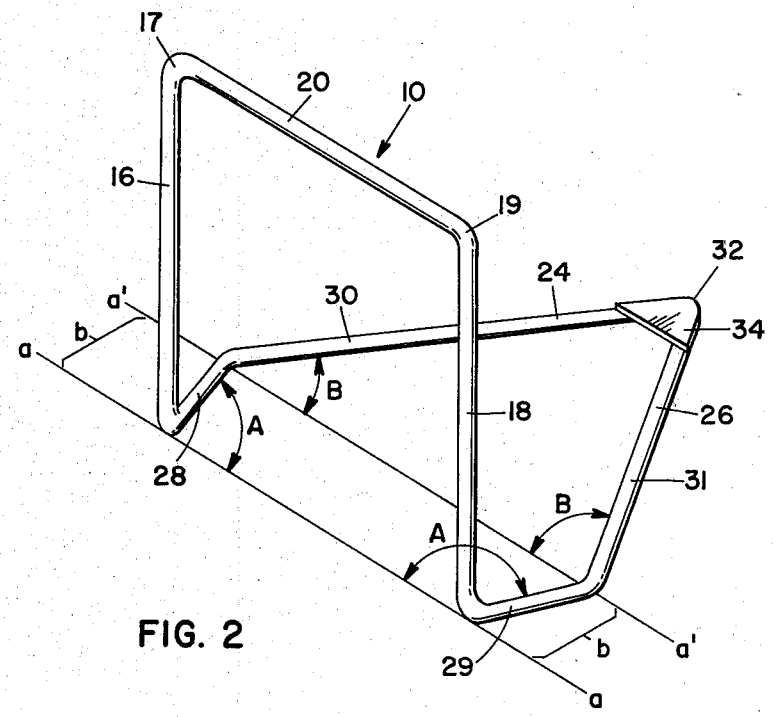
FIG. 2 shows the frame for a lacrosse goal of the present invention.

Each of the leg members (24) and (26) is comprised of two portions, and this is shown more clearly in FIG. 2. In this drawing, a first portion of leg (24) is shown as (28), and a second portion beginning at a point disposed at a distance shown as (b) in FIG. 2 is shown as (30).

Likewise, a first portion of leg (26) is shown as (29), and a second portion beginning at a point disposed at a distance shown as (b) in FIG. 2 is shown as (31). In the frame of the present invention, it is intended that the first portion of each leg be disposed such that it forms an obtuse angle opening away from the plane of the goal mouth. Thus, the angle (A) formed between portion (28) of leg (24) and the bottom of the goal mouth represented by the line (aa) in FIG. 2, must exceed 90°. Likewise, an equal angle (A) is formed between portion (29) of leg (26) and the bottom of the goal mouth on the opposite side.

At some point disposed rearward of the goal mouth at a distance shown as (b) in FIG. 2, a second portion (30) of leg (24) begins and forms an acute angle (B) with the translated plane of the goal mouth, represented by the line (a'a') in FIG. 2. Likewise, at a point disposed rearward of the goal mouth at the same distance (b), a second portion (31) of leg (26) begins and forms the same acute angle (B) with the translated plane of the goal mouth, represented by the line (a'a') in FIG. 2. The distance (b) may vary from approximately one foot to approximately three feet from the goal mouth in order to accomplish the aims of the present invention. However, a distance of twenty inches is presently preferred.

The angles (A) are measured opening outwardly from the center of the bottom of goal mouth, represented by the line (aa). The angles (B) are measured opening outwardly from the center of the bottom of the translated goal mouth plane, represented by the line (a'a').

At some point further rearward, represented as (32) in FIG. 2, the second portion (30) of the leg (24) and the second portion (31) of leg (26) meet and are interconnected. It is advantageous, particularly at present, to form this connection, at least partly, by affixing a flat plate (34) covering a small portion of the rear periphery of the second portion (30) of leg (24) and the second portion (31) of leg (26), although a portion of tubular pipe would serve the same purpose. This is of advantage because it allows the nets used with the prior art to be used with the frame of the present invention, which has a slightly wider base area. This will allow the frame of the present invention to be used without the necessity of replacing the nets presently in use with nets specifically designed for the frame of the present invention.

The net, shown as (14) in FIG. 1, may be attached to the frame (10) of the present invention by passing internal loops over the frame members, by trying or by any method currently known to the art.

For the purpose of this invention, to prevent balls from re-entering the playing field after entering the goal, it is necessary to have the angle (A) greater than 90°. It is advantageous to have the angle (A) between 90° and 110°, and most advantageous to have the angle (A) between 100° and 102°. At some value of (A) greater than 110° however, the advantages of the present invention are outweighed by the problems introduced by the near perpendicularity of the rear portions of the legs to the incident angle of a ball coming directly into the goal, and by the intrusion of the goal enclosures into the playing area which extends around the sides of the goal enclosure.

At present, it is most advantageous to construct the frame members from some type of metal such as tubular steel. This is particularly true in that only metal-framed goals are currently approved by the USILA. It should be noted however, that it is entirely possible to construct the frame from numerous other structural materials, and such constructions are intended to be within the scope of the present invention.

Other features, advantages and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while a specific embodiment of this invention has been described in considerable detail, variations and modifications of this embodiment can be effected without departing from the spirit and scope of the invention as disclosed and claimed.

What we claim is:

1. A frame for a lacrosse goal comprising:

two upright frame members;

a crossbar frame member joining the upper ends of the upright members, said crossbar together with the upright members defining a vertical plane and enclosing that portion thereof which constitutes a goal mouth;

a base having two leg members, each leg member having a first end interconnecting with the other leg at the rear periphery of the frame and a second end which connects to the lower end of one of the upright members, said base extending rearward in the plane perpendicular to the plane of the goal mouth, thereby defining a goal enclosure;

in which a first portion of each said leg immediately rearward of the goal mouth forms an obtuse angle with the plane of the goal mouth, and a second portion of each said leg, beginning at a point disposed at a slight distance from the plane of the goal mouth forms an acute angle with the plane of the goal mouth.

2. The frame of claim 1 in which the obtuse angle formed by the first portion of each leg with the plane of the goal mouth is between 90° and 110°.

3. The frame of claim 1 in which the obtuse angle formed by the first portion of each leg with the plane of the goal mouth is between 100° and 102°.

4. The frame of claim 1 in which a small portion of the rear portion of each leg is covered by a flat plate at their rearward periphery.

* * * * *